US007730816B2

(12) United States Patent
Yamamoto

(10) Patent No.: US 7,730,816 B2
(45) Date of Patent: Jun. 8, 2010

(54) PRESS APPARATUS, STRIKER CONTROL MODULAR TOOL APPARATUS AND PROGRAMMABLE METHOD FOR PUNCHING APERTURES INTO A WORKPIECE

(75) Inventor: Koji Yamamoto, Buena Park, CA (US)

(73) Assignee: Amada America, Inc., Buena Park, CA (US)

( * ) Notice: Subject to any disclaimer, the term of this patent is extended or adjusted under 35 U.S.C. 154(b) by 0 days.

(21) Appl. No.: 10/103,766

(22) Filed: Mar. 25, 2002

(65) Prior Publication Data

US 2002/0139229 A1 Oct. 3, 2002

Related U.S. Application Data

(60) Provisional application No. 60/279,430, filed on Mar. 29, 2001.

(51) Int. Cl.
*B26F 1/14* (2006.01)

(52) U.S. Cl. ..... 83/39; 83/255; 83/257; 83/684; 29/564

(58) Field of Classification Search ..... 83/39, 83/76.9, 255, 550, 40, 555, 45, 52, 203, 212.1, 83/357, 356.2, 257, 552, 684–688; 29/564; 408/31; 72/455, 456
See application file for complete search history.

(56) References Cited

U.S. PATENT DOCUMENTS 3,449,991 A * 6/1969 Daniels ..... 83/76.9
4,118,660 A 10/1978 Ohtsuki et al.
4,532,843 A * 8/1985 Miyama ..... 83/409
4,587,396 A 5/1986 Rubin
4,771,663 A * 9/1988 Naito et al. ..... 83/49
4,951,375 A * 8/1990 Erlenmaier ..... 483/4
4,978,901 A * 12/1990 Hirai ..... 318/600
4,989,483 A * 2/1991 Lacrouts-Cazenave ..... 83/76.9

(Continued)

FOREIGN PATENT DOCUMENTS

DE 4128194 3/1993

(Continued)

OTHER PUBLICATIONS

English language Abstract of JP 9-201632.

(Continued)

*Primary Examiner*—Phong H Nguyen
(74) *Attorney, Agent, or Firm*—Greenblum & Bernstein, P.L.C.

(57) ABSTRACT

A press apparatus includes an inputting device, that enables a user of the press apparatus to input working pattern data representing the workpiece, and a display device, that displays a working pattern of the workpiece based on the inputted working pattern data. A tool selecting device selects a plurality of tools required for working the workpiece in accordance with the working pattern data. A calculator calculates a transferring pitch of the workpiece in order for parts of the workpiece to be sequentially arranged in predetermined positions in a feeding direction of the press apparatus with respect to the plurality of tools selected by the tool selecting device. In this regard, the calculator also determines which tool is to be operated in association with the transferring pitch. The press includes a controller that controls the transferring pitch calculated by the calculator.

1 Claim, 11 Drawing Sheets

U.S. PATENT DOCUMENTS

| | | | | | |
|---|---|---|---|---|---|
| 5,033,342 | A | * | 7/1991 | Nordlof | 83/73 |
| 5,046,232 | A | * | 9/1991 | Mise | 29/564 |
| 5,271,140 | A | * | 12/1993 | Futamura et al. | 29/33 K |
| 5,347,898 | A | * | 9/1994 | Ito | 83/27 |
| 5,669,866 | A | * | 9/1997 | Julian et al. | 483/1 |
| 5,857,397 | A | * | 1/1999 | Matsubayashi et al. | 83/556 |
| 6,013,017 | A | * | 1/2000 | Aizawa | 483/29 |
| 6,334,378 | B1 | * | 1/2002 | Tsuzaki et al. | 83/39 |

FOREIGN PATENT DOCUMENTS

| | | |
|---|---|---|
| EP | 0658383 | 6/1995 |
| FR | 2540422 | 8/1984 |
| JP | 57106435 | 7/1982 |
| JP | 60-20096 | 5/1985 |
| JP | 9-160625 | 6/1997 |
| JP | 9-201632 | 8/1997 |
| JP | 10-258329 | 9/1998 |

OTHER PUBLICATIONS

English language Abstract of JP 9-160625.
English Language Abstract of JP 57-106435, 1982.
English Language Abstract of JP 9-201632, 1997.
English language Abstract of JP 10-258329, 1998.
English language Abstract of DE 4128194, 1993.
English language Abstract of EP 0658383, 1995.
English language Abstract of FR 2540422, 1984.

* cited by examiner

FIG.9

| WORKING HOLE | H1 | H2 | H3 | H4 | H5 | H6 | H7 | H8 | H9 | H10 | H11 | H12 | H13 | H14 |
|---|---|---|---|---|---|---|---|---|---|---|---|---|---|---|
| TOOL | K1 | K1 | K2 | K3 | K2 | K1 | K3 | K1 | K1 | K2 | K1 | K1 | K1 | K4 |

PRESS APPARATUS, STRIKER CONTROL MODULAR TOOL APPARATUS AND PROGRAMMABLE METHOD FOR PUNCHING APERTURES INTO A WORKPIECE

This application is based upon U.S. Provisional Application No. 60/279,430 filed on Mar. 29, 2001, the subject matter of which is expressly incorporated by reference into the present application.

BACKGROUND OF THE INVENTION

1. Field of the Invention

The present invention is directed to a press apparatus and tool apparatus for working a sketch, strip material or a long material (such as, for example, a coiled material), while transferring them in a longitudinal direction.

2. Discussion of Background and Relevant Information

A conventional press apparatus for long material, in which a workpiece of a sketch, strip material or a long material, such as a coiled material, is transferred in a longitudinal direction to be worked, as shown in Japanese Laid-Open Patent Application Nos. SHO 57-10634 and SHO 60-20096, is known. Such a press apparatus usually has two tool units that include punches and dies. The two tool units are operated simultaneously, or one of them is selected for working while a workpiece of the sketch, strip material (or long material) is transferred progressively at the same pitch in the longitudinal direction.

Another conventional press apparatus that eliminates a cumbersome data setting and allows press working having a high efficiency and high precision, and permitting a flexible production, is shown in Japanese Laid-Open Patent Application No. HEI 9-201632.

Because the above discussed press apparatus has only two tool units, only two hole shapes, for example, for a product (work) can be selected. Thus, the above discussed press apparatus cannot accommodate a plurality of shapes. Further, a progressive feeding at the same pitch for working prevents substantially increasing the size of a product, thus limiting the size of the product to be produced. Further, when one tool unit is selected, a stroke between a striking position and a non-striking position should be provided by a dimension of a struck surface. The large size of the struck surface makes the stroke larger, preventing a high-speed operation.

Further, the above discussed press apparatus does not provide for the prioritizing and arranging of tools. Thus, an operator must select required tools and determine the order and positions of the tools, which reduces the operating speed and efficiency of the press apparatus.

SUMMARY OF THE INVENTION

The present invention seeks to solve the above problems by providing a press apparatus and tool apparatus having at least three tool units that are appropriately spaced in a longitudinal direction of a workpiece, in which a random pitch (distance) feeding is possible, a plurality of different shaped holes can be randomly punched, and a relatively long product can be worked.

In order to attain the above object, a press apparatus comprises a press with a ram that is movable in an upward and downward direction, and a loading apparatus that loads a blank material (or long material), such as, for example, a coiled material, into the press. The press apparatus is programmable, including a device for inputting product pattern data of the workpiece, a device for displaying a product pattern (or a likeness of the workpiece) in accordance with product pattern data inputted by the inputting device, a device for selecting a tool from a plurality of tools in response to the product pattern data, a device for calculating a transferring pitch of the workpiece in order for parts of the workpiece to be worked to be sequentially arranged in positions of the plurality of tools selected by the tool selecting device in the feeding direction, a device for determining a tool to be operated in association with the transferring pitch; and a controlling section that controls the transferring pitch calculated by the transferring pitch and operating tool calculating device and motion of the tool determined in association with the transferring pitch.

Accordingly, the plurality of tools required for working is selected by the tool selecting device based on the inputted product pattern data. The transferring pitch and operating tool calculating device calculates a pitch for transferring the workpiece in order for the parts of the workpiece to be worked upon to be sequentially arranged in association with the positions of the tools determined by the tool position determining device in the feeding direction, and further determines the specific tool to be used in association with the transferring pitch. The controlling section controls the transferring pitch calculated by the transferring pitch and operating tool calculating device, and motion of the tool determined in association with the transferring pitch, to perform the press working of the workpiece.

Thus, the workpiece of a strip material or coil material is transferred in the longitudinal direction to be arranged with respect to the tools in the transferring direction of the workpiece W at a lower position of the ram which is movable in an upward and a downward direction. Desired tools to be used are selected from among the plurality of tools to be selectively (or simultaneously) used in various combinations for press working. It is noted that in press working, the workpiece is fed at an arbitrary pitch in the longitudinal direction and the tools are placed in the corresponding positions relative to the workpiece, to different hole positions in the product, and that such an arrangement permits the working of a longer product than a conventional press, because of the controlled activation of separate cutting tools by a striker program.

According to a feature of the invention, the press includes a ram that is upwardly and downwardly movable, and a loading apparatus that loads a workpiece into the press. The press programming system includes a device for inputting working pattern data of the workpiece, a device for displaying a working pattern of the workpiece based on the inputted working pattern data, a device for selecting a plurality of tools required for working in accordance with the working pattern data, a device for determining a position of each of the plurality of selected tools in a striker activation order at an arbitrary pitch, a device for calculating a transferring pitch of the workpiece in order for parts of the workpiece to be worked to be sequentially arranged in the positions of the tools determined by the tool position determining device in the feeding direction and determining a tool to be operated in association with the transferring pitch, and a controlling section that controls the calculated transferring pitch and motion of the tool.

The plurality of tools required for working is selected by the tool selecting device based on the inputted working pattern data. The tool position determining device determines a position of each required tool (of the plurality of tools) in an arbitrary order at an arbitrary pitch. The pitch for transferring the workpiece is calculated in order for the parts of the workpiece to be sequentially arranged with respect to the positions of the tools determined by the tool position determining device in the feeding direction. A tool to be operated is determined in association with the transferring pitch. The controlling section controls the transferring pitch, while the motion of the tool is determined in association with the transferring pitch, to perform the press working of the workpiece.

Thus, the workpiece is transferred in the longitudinal direction so that the tools are positioned in the transferring direction of the workpiece at a lower position of the ram, and the desired tools are selected. The workpiece is fed at an arbitrary pitch in the longitudinal direction and tools in the positions corresponding to positions of the workpiece to be worked are selectively operated, to, for example, punch randomly different hole positions in the product, which permits working on a longer product than with a conventional press.

According to the present invention, a software programmable press includes a tool layout determining device that arranges a tool with the greatest punch out tonnage among the plurality of tools required for working selected by the tool selecting device, in a middle part (central location) below the ram, and arranges the remaining tools at a front location and a back location, with respect to the middle part.

Accordingly, a tool with the greatest punch out tonnage among tools required for working selected by the tool selecting device is arranged in the middle part below the ram, and the remaining tools are arranged at the front and back of the middle part, whereby an eccentric load is prevented to improve the precision of the punching operation.

According to an advantage of the invention, the tool position determining device arranges a tool having a high punching frequency on center, if all of the punch tools require small tonnage (or almost the same tonnage) other than the final cutting tool, so as to obtain a center load balance.

According to another advantage of the invention, the tool position determining device arranges the tool having the shape of a working pattern closer to the tool side, proximate a workpiece feeding side of the press.

Accordingly, a tool having the shape of the working pattern is positioned closer to the workpiece feeding side, so as to improve the productivity of the press.

A still further advantage is that the apparatus includes a punch base with a punch corresponding to a die, in which the punch is upwardly and downwardly movable above a die base with the die, in which at least two punch heads to be struck by a striker are separately provided above the punch base. The at least two punch heads to be struck by the striker are separately provided on the punch base, so that the separate punch heads are struck by the striker simultaneously and evenly at a predetermined load face pressure. Further, the punch heads are separated in the moving direction of the striker, so that an escape pitch can be shortened as compared with conventional ones, which permits a high-speed operation.

According to another object of the invention, a software programmable press is provided for punching apertures into a workpiece. The software programmable press includes an inputting device, a display device, a tool selecting device, a calculator, and a controller. The inputting device enables a user of the press apparatus to input working pattern data representing the workpiece. The display device displays a working pattern of the workpiece, based on the inputted working pattern data. The tool selecting device selects a plurality of tools required for working the workpiece in accordance with the working pattern data. The calculator calculates a transferring pitch of the workpiece in order for parts of the workpiece to be sequentially arranged in predetermined positions in a feeding direction of the press apparatus with respect to the plurality of tools selected by the tool selecting device. The calculator also determines which tool is to be operated in association with the transferring pitch. The controller controls the calculated transferring pitch.

According to a feature of the invention, the plurality of tools comprise a plurality of punches that are used to create predetermined apertures in the workpiece.

According to another feature of the invention, the workpiece comprises a sketch, strip material or long material. The long material may be, for example, a coiled material.

According to another object of the invention, a software programmable press is disclosed that comprises a press having a ram that is movable in an upward direction and a downward direction, and a loading apparatus that loads a workpiece into the press apparatus. The software programmable press includes an inputting device that is useable for inputting working pattern data of the workpiece. A display device displays a working pattern of the workpiece in accordance with the inputted working pattern data. A selecting device selects a plurality of tools required for working the workpiece in accordance with the working pattern data. A tool layout (position) determining device determines placement positions of the selected plurality of tools. A calculating device calculates a transferring pitch of the workpiece in order for parts of the workpiece to be sequentially arranged in a feeding direction of the press with respect to the placement positions of the selected plurality of tools, and for determining a tool to be operated in association with the transferring pitch The controlling section controls the transferring pitch and a motion of the tool in accordance with the calculated transferring pitch.

According to an advantage of the invention, the workpiece comprises, for example, a sketch, strip material or a long material, such as, for example, a coiled material.

According to a feature of the invention, the tool position determining device arranges a tool with a greatest punch out tonnage, among the selected plurality of tools, at a central location below the ram, the tool position determining device arranging remaining tools in front of and behind the central location.

According to another feature of the invention, the tool position determining device arranges a tool having a high punching frequency on center, so as to obtain a center load balance.

According to another object of the invention, a method is disclosed for controlling a punching operation of a press apparatus. Working pattern data related to a workpiece is input, and a working pattern of the workpiece is displayed in accordance with the inputted working pattern data. A plurality of tools required for working the workpiece in accordance with the working pattern data are then selected. Placement positions of the selected plurality of tools is then determined, after which a transferring pitch of the workpiece is calculated in order for parts of the workpiece to be sequentially arranged in a predetermined direction with respect to the placement position of the selected plurality of tools, in accordance with a priority selection in a tool layout function of the programmable software, and for determining a tool to be operated in association with the transferring pitch. The transferring pitch and a motion of the tooling on each process is controlled in association with the calculated transferring pitch.

According to a feature of the invention, a tool with a greatest punch out tonnage, from among the selected plurality of tools, is arranged in a central location of the press apparatus, while the remaining tools are arranged in front of the central location and behind the central location.

According to another feature of the invention, a tool having a greatest punching frequency, from among the selected plurality of tools, is arranged on center, so as to obtain a center load balance.

According to a still further feature, a tool having a shape corresponding to the working pattern is arranged proximate the workpiece feeding side of the press apparatus.

BRIEF DESCRIPTION OF THE DRAWINGS

The foregoing and other objects, features, and advantages of the invention will be apparent from the following more particular description of the preferred embodiment, as illustrated in the accompanying drawings, in which reference characters refer to the same parts throughout the various views, and wherein:

FIG. 9 is a diagram of an exemplary selection of tools based on the pattern of a product to be produced;

DETAILED DESCRIPTION

Embodiments of the present invention will be described below with reference to the accompanying drawings.

Figure 1:
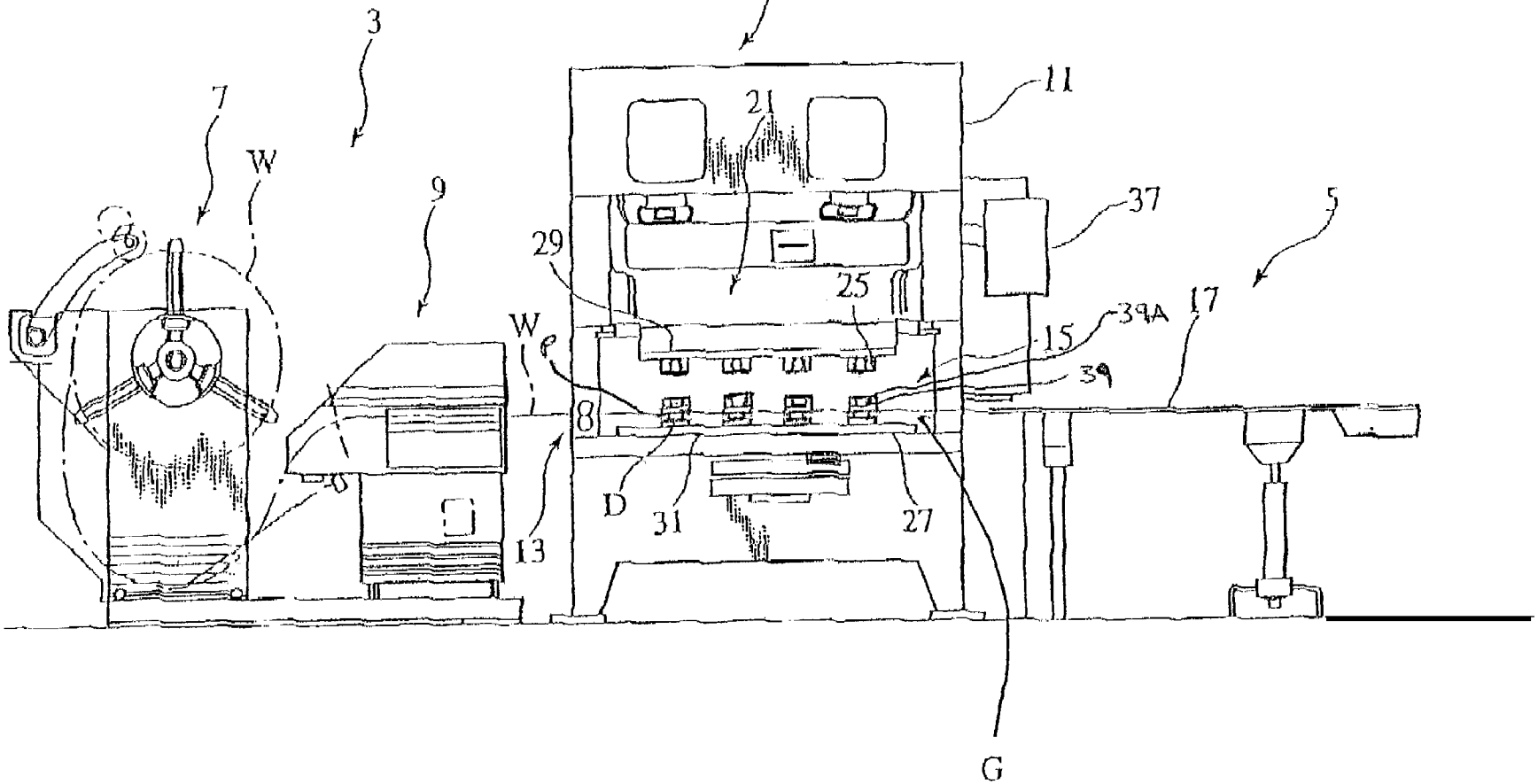
FIG. 1 illustrates a front view of a press apparatus, a loading apparatus and an unloading apparatus.

FIG. 1 illustrates a press apparatus 1 flanked by a loading apparatus 3 and an unloading apparatus 5, respectively, arranged on the left and right in FIG. 1 of the press apparatus 1. The loading apparatus 3 comprises an uncoiler 7 and a leveler and feeder 9. The uncoiler 7 feeds (decoils) workpieces (such as, but not limited to, for example, an endless web-like coiled material W) through the leveler and feeder 9 that flattens the coiled material W. The leveled (flattened) workpiece W is then fed to feeder 13, which operate to feed the workpiece W through the press apparatus 1 to a working area (station) 15 of the press body 11 to be punched. The resulting punched products G are unloaded (fed out) from the working area 15 of the press apparatus 1, via, for example, a conveyor belt or unloading system, to an unloading table 17 of the unloading apparatus 5. While the present invention is described with respect to a side-to-side feeding of the workpiece W, the instant press also enables a front-to-back feeding of the workpiece W and a back-to-front feeding of the workpiece W, so as to produce various width products.

The press body 11 utilizes a modular tooling station. In this regard, the press is provided at its upper part with a ram 21 that is movable in a vertical direction (e.g., upwardly movable and downwardly movable), such as, for example, a mechanism which can be hydraulically or mechanically powered. A plurality of strikers 25 are provided below the ram 21 and are appropriately spaced and movable in a direction perpendicular to the feeding direction (e.g., the workpiece W feeding direction) with the assistance of a striker moving device 23 (see FIG. 3).

The programmable press system includes an upper strike plate (tool unit) 29 and a lower strike plate (tool unit) 31. The plurality of striker 25 are secured to the upper strike plate 29. Dies (lower tools) D are attached to an upper surface of the lower tool unit 31. Strikers 25 are selectively positionable with respect to the upper tool unit 29 in the directions shown by the arrow in FIGS. 2A and 2B. The punches (upper tools) P are located above the lower dies D, which form a tooling set. However, it is understood that variations in the specific arrangement of the press components may be implemented without affecting the scope and/or spirit of the invention.

In order to drive the feeder 13, for example, a pinch roller driving servo control motor 35 (see FIG. 3) having an encoder 33 is connected to the pinch rollers 13. A controller 37 (schematically illustrated as located on the right side of the press apparatus 1 in the disclosed embodiment) controls the operations of the press 1 (including the servo control motor 35), the loading apparatus 3, and the unloading apparatus 5. Alternatively, a controller may be employed to control the loading apparatus 3 and the activation of the strikers. In this regard, it is appreciated that various control schemes may be employed without departing from the spirit and/or scope of the invention.

Figure 2A:
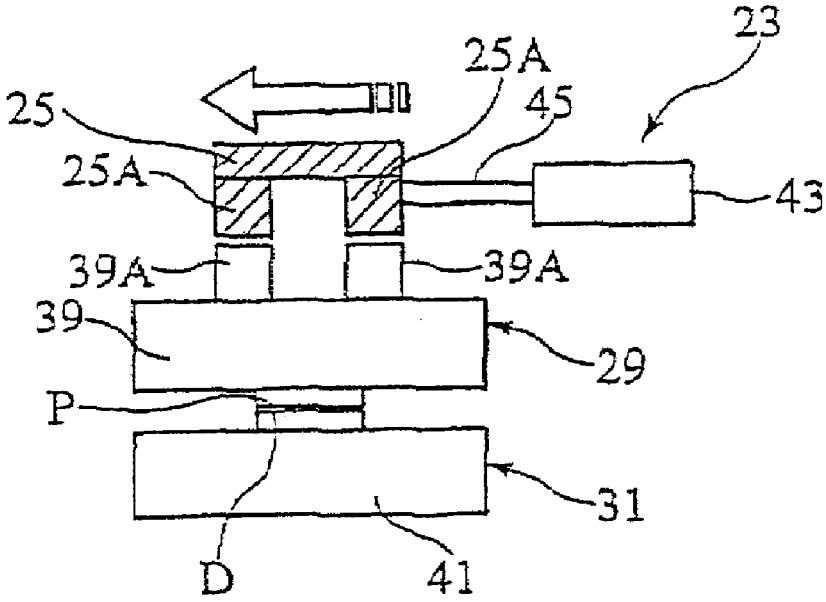
FIGS. 2A and 2B are schematic diagrams of a side view of a tool apparatus with a striker system, a punch base having a punch, corresponding to a die, movable in an upward and a downward direction relative to a die base having the die.

The upper tool unit 29 and the lower tool unit 31 have, as shown in FIG. 2A, a punch base 39 with the punch P corresponding to the die D, and a die base 41 with the die D, respectively. The punch base 39 (with the punch P corresponding to the die D) is movably provided in the vertical direction above the die base 41. On the top of the punch base 39, a plurality of punch heads 39A, such as, for example, two punch heads, to be struck by the striker 25, are provided separately in the moving direction of the striker 25. Alternately, the punch heads 39A can be provided separately in a circular arc direction for activation of each striker 25. The striker 25 is provided at its bottom with striking members 25A that correspond to the respective punch heads 39A. In the disclosed embodiment, a front end of a piston rod 45 attached to an air cylinder 43 functions as the striker moving device 23 that is illustrated as being attached to the striking member 25A on the right side in FIG. 2A. However, it is understood that alterations may be made thereto without departing from the scope and/or spirit of the invention. For example, the press can be designed to position the strikers at a predetermined location, and the piston rod 45 is secured to the upper tool unit 29 to make the upper tool unit 29 movable in the direction of the arrow shown in FIGS. 2A and 2B.

Figure 2B:
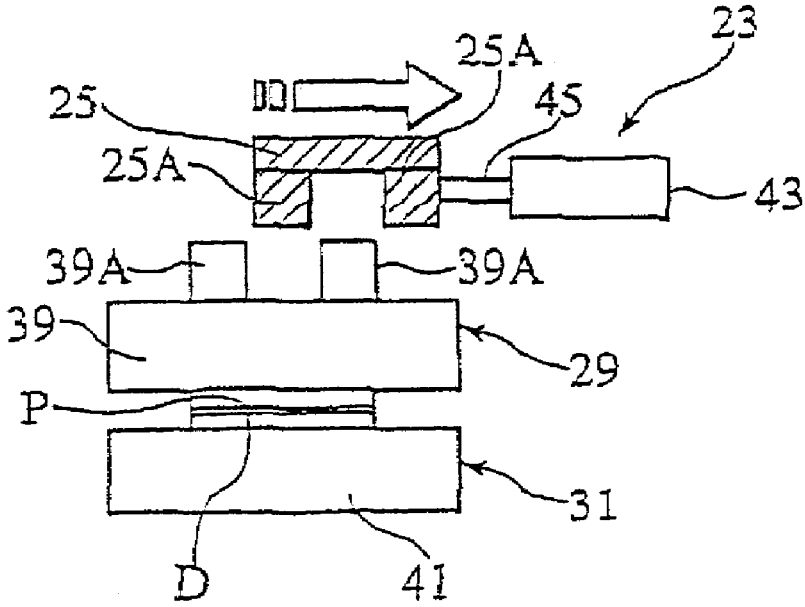

With the above structure, the punch heads 39A are struck by moving the striker 25 downward with the vertical motion of the ram 21, as shown in FIG. 2A, to have the punch heads 39A struck by the striking members 25A, thereby pressing the workpiece W with the cooperation of the punch P and the die D. When the air cylinder 43 is operated to retract (withdraw) the piston rod 45, as shown in FIG. 2B, the striking members 25A are dislocated (moved) from the striking position above the punch heads 39A to a non-striking position. Consequently, when the striker 25 is moved downward by the vertical motion of the ram 21, the striking members 25A fail to strike the punch heads 39A. Accordingly, the workpiece W is not press worked by the punch P and the die D.

Thus, in such a tool apparatus having the punch base 39 with the punch P corresponding to the die D, movable in the vertical direction above the die base 41 with the die D, the two punch heads 39A to be struck by the striker 25 are separately provided on the top of the punch base 39. Consequently, the separated punch heads 39A are simultaneously and evenly struck by the striker 25 at an increased load face pressure. Further, the fact that the punch heads 39A are separated apart by a predetermined distance in the moving direction of the striker 25 (shown by the arrow) permits a shorter escape pitch than is provided in a conventional device, which leads to a speedier operation. Punch heads 39A and striker head 25A may have any desired shape, such as, but not limited to, for example, a square block, a trapezoid, etc.

Figure 3:
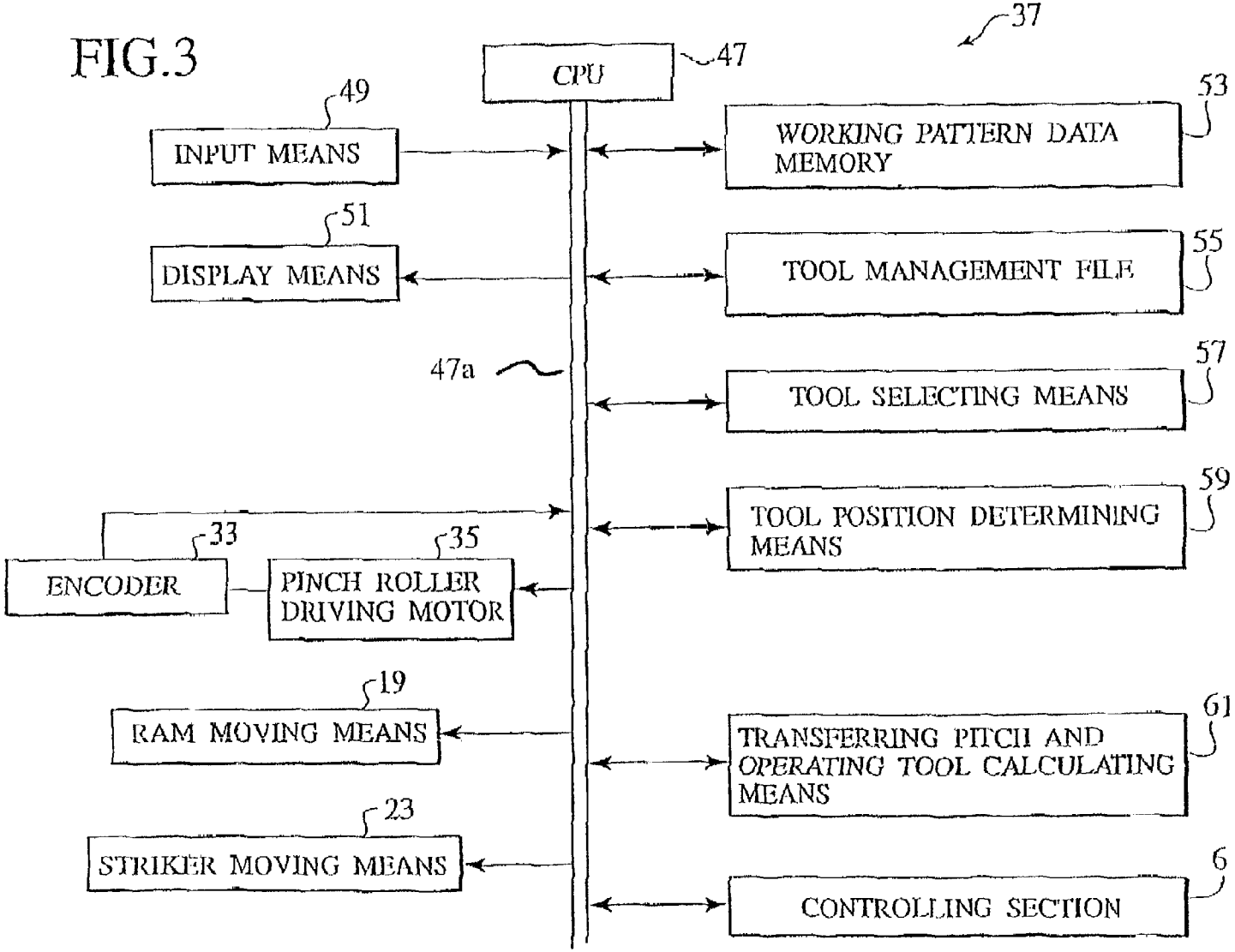
FIG. 3 illustrates a block diagram of a control structure that controls the press apparatus and the loading apparatus of the present invention.

A block diagram of the controller 37 is illustrated in FIG. 3. Controller 37 includes a processor (CPU) 47 and a bus 47*a*. In addition, an input device 49, an output device 51, a pinch roller driving motor 35, an encoder 33, a ram moving device 19, a stricker moving device 23, a working pattern data memory 53, a tool management file 55, a tool selecting device 57, a tool position determining device 59, transferring pitch and operating tool calculating device 61, and a controlling section 63 are also interfaced to the bus 47*a*. It is noted that controller 37 may not only be the controller as shown in FIG. 1, but may also be an individual system controller located on the floor, acting with a parent station or a computer that supports the above functions.

The input device 49, comprises, but is not limited to, for example, a keyboard that enables an individual to input working pattern data of the workpieces W, including, but not limited to, for example, information pertaining to the specific material, plate thickness, coil width, shape, and size of the workpieces W. The output device (display device) 51, comprises, but not limited to, for example, a CRT display that functions to display a working pattern of the workpieces W based on the working pattern data inputted by the input device 49. Alternative input devices, such as, but not limited to, for example, a mouse, tablet, PDA, a voice recognition device (either hardware or software) may be used without affecting the scope and/or spirit of the invention. Similarly, alternative output devices, such as, but not limited to, for example, a projector, printer, LCD display, voice synthesizing device, plasma display device (PDP), may be used in place of the CRT display 51.

Figure 4:
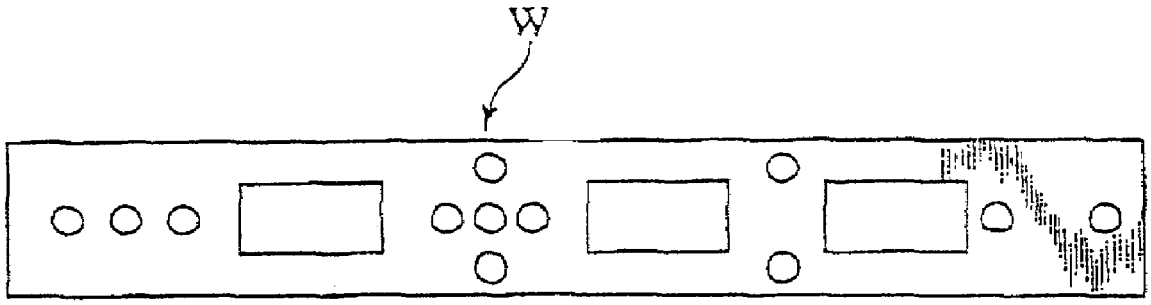
FIG. 4 illustrates a plan view showing an example of working pattern data.

The working pattern data memory 53 functions to store working pattern data of the workpieces W, an example of which is shown in FIG. 4, which was inputted by, for example, the input device 49.

Figure 5:
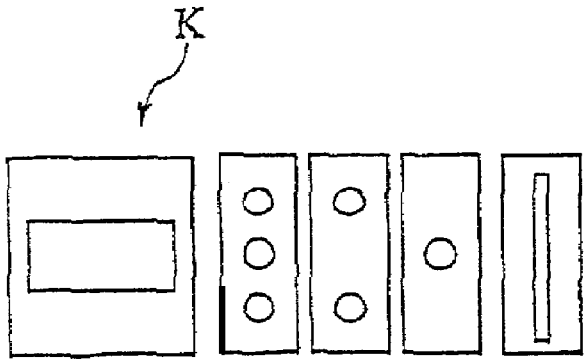
FIG. 5 illustrates a plan view showing a plurality of tools selected in accordance with the working pattern data of FIG. 4.

The tool management file 55 operates to manage a plurality of tools based on the shape, size, number, history and the like of a product. The tool management file 55 files data on a plurality of tools K required for working, such as, for example, five tools (see FIG. 5), which is based on the working pattern data shown in FIG. 4, that is stored in the working pattern data memory 53.

Figure 6:
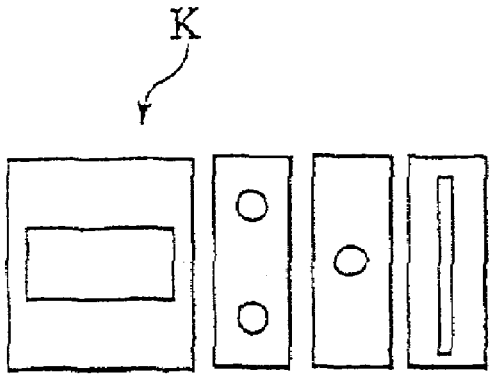
FIG. 6 is a plan view showing an example of a minimized tool selection in accordance with the working pattern data.

The tool selecting device 57 operates to select the tools required for a particular task, such as, for example, four tools K, an example of which is shown in FIG. 6, from the five tools K managed by the tool management file 55.

The tool position determining device 59 operates to determine the positions of the four tools K (that were selected by the tool selecting device 57) in an arbitrary order at an arbitrary pitch (distance).

The transferring pitch and operating tool calculating device 61 calculates a pitch for sequentially arranging the tools K in the feeding direction positions determined by the tool position determining device 59, and for determining which particular tool K is to be operated in association with the transferring pitch.

The controlling section 63 functions to control the operation of the tool in association with the transferring pitch calculated by the transferring pitch and operating tool calculating device 61.

The selection of the tools K shown in FIG. 6 (from the tools K shown in FIG. 5) by the tool selecting device 57 will now be described. Data of a product (or products) to be worked, including data pertaining to plate thickness, material properties (e.g., tensile stress) and working number (e.g., 100 pieces of product A and 100 pieces of product B) of a single or a plurality of kinds of products is displayed on CRT display 51. The product, displayed on, for example, the CRT display (screen) 51, is provided with a plurality of different shaped holes (such as, for example, circular holes and rectangular holes), as shown in FIG. 4. An operator, seeing the holes (apertures) on the screen 51, picks up and drags appropriate punch tools displayed on the same screen so as to group the same or similar hole positions (layout) of the same holes, to determine the punch tools. With this determination, a working tonnage (a working tensile length X a plate thickness X a tensile stress X 1.1 (e.g., a safety factor value) is displayed. A program is thereafter created after the tool layout is determined for all the holes to be punched (based on, for example, a least common multiple calculation), to determine the punch tools required for working. The decision of the required punch tools leads to the decision of the number of workstations.

Next, the tool position determining device 59 determines a layout of the punch tool stations before determining the tool positions in accordance with a predetermined layout. In the disclosed embodiment, there are three layout types: a standard type layout, in which the punch tools are arranged at "an equal pitch" in accordance with existing tool mounting positions and the positions of the strikers 25 provided below the ram 21; a space-saving type layout, in which spaces between stations are lessened in consideration of a press having a small tool mounting size below the ram 21 (e.g., the tool layout size is determined within the size of the bottom surface of the ram 21 of a given press machine); and a high-productivity type layout, which provides a punch tool station layout in which two or more punch tools are simultaneously struck to shorten (reduce) the cycle time. With respect to a standard type layout or a space saving type layout, it is noted that the flexible and compatible type striker system of the present invention allows each station to individually and/or concurrently utilize multiple side by side strikers that are placed together to form a wide working space for a large size tool. Depending on the working area requirement of one tool, it is selected to use one (or a few) strikers together for one tool set without the changing of the upper striker system, when one of the tooling size is wider than one standard tooling station of the standard type and/or space saving type layout. It is understood that alternative layout types (or additional layout types) may be used with the present invention without departing from the scope and/or spirit of the invention.

In the high-productivity type layout, it is required to provide pitches between punch tool stations which are commensurate with dimensions between holes of a product to be simultaneously punched. Consequently, when this type layout is selected, the number of stations determined in the standard type layout are arranged so that the selected tool position corresponds to the product punch pattern as far as possible, so as to increase the production speed by enabling the concurrent punching using minimal striker activations.

The tool position determining device 59 determines the positions (locations) of the blank tools in accordance with the following conditions:

Condition A: In order to prevent an eccentric load (e.g., improve the punching precision), a tool with the greatest punch out tonnage is arranged among a plurality of tools required for working as selected by the tool selection device 57, in the middle part (e.g., central location) below the ram, and the remaining tools are arranged in front of the middle part and behind the middle part. In the disclosed embodiment, a shearing tool K4 (see FIG. 8), that cuts ends of the workpieces W, is arranged in the most distant position from a workpiece feeding side, even if it has the greatest punch out tonnage. However, the position of the shearing tool K4 can be varied without departing from the spirit and/or scope of the invention;

Condition B: In order to maximize machine space for a plurality of tools required for working as selected by the tool selection device 57, a plurality of tools are arranged as close as possible for maximum utilization of capacity.

Condition C: In order to further improve productivity, the selection (position) of the tools K is selected to correspond to the order in which the holes (apertures) are to be punched in the workpiece W. However, if such an arrangement results in an unbalanced loading of the tools K, the tools K are offset to obtain a center loading. Alternatively, the order of the tools K can be re-arranged until a desired balance is achieved.

One of the above three conditions A, B and C is selected as necessary.

Figure 7A:
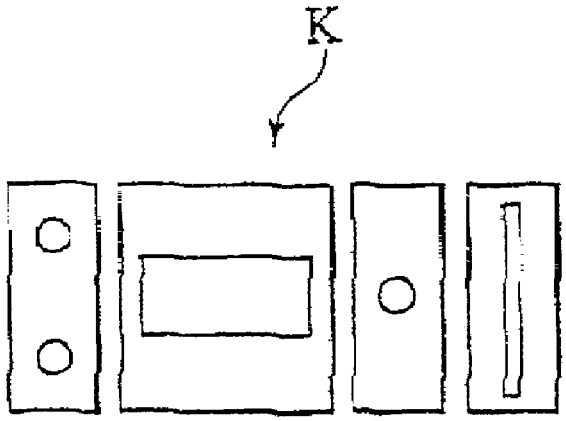
FIGS. 7A and 7B are plan views showing tool positioning examples of the selected tools.
Figure 7B:
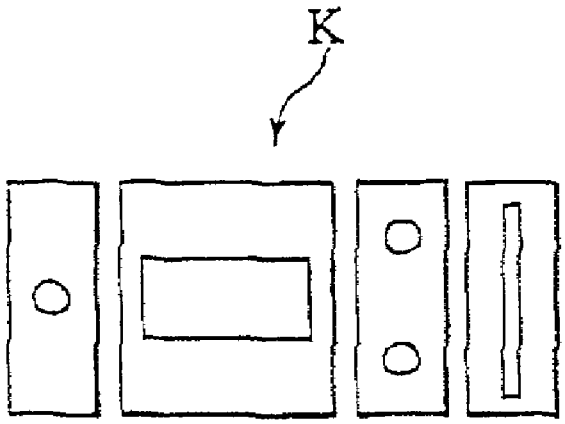

In the disclosed embodiment, in the case of positioning the tools K as shown in FIG. 6, as selected by the tool selecting device 57 under Condition A, the tools are arranged as shown in either FIG. 7A or FIG. 7B. In positioning the tools K under Condition B, the arrangement is as shown in FIG. 7B. In the case of positioning the tools K under Condition C, the arrangement is also as shown in FIG. 7B. However, it is understood that alternative arrangements may be implemented without departing from the scope and/or spirit of the present invention.

Figure 8:
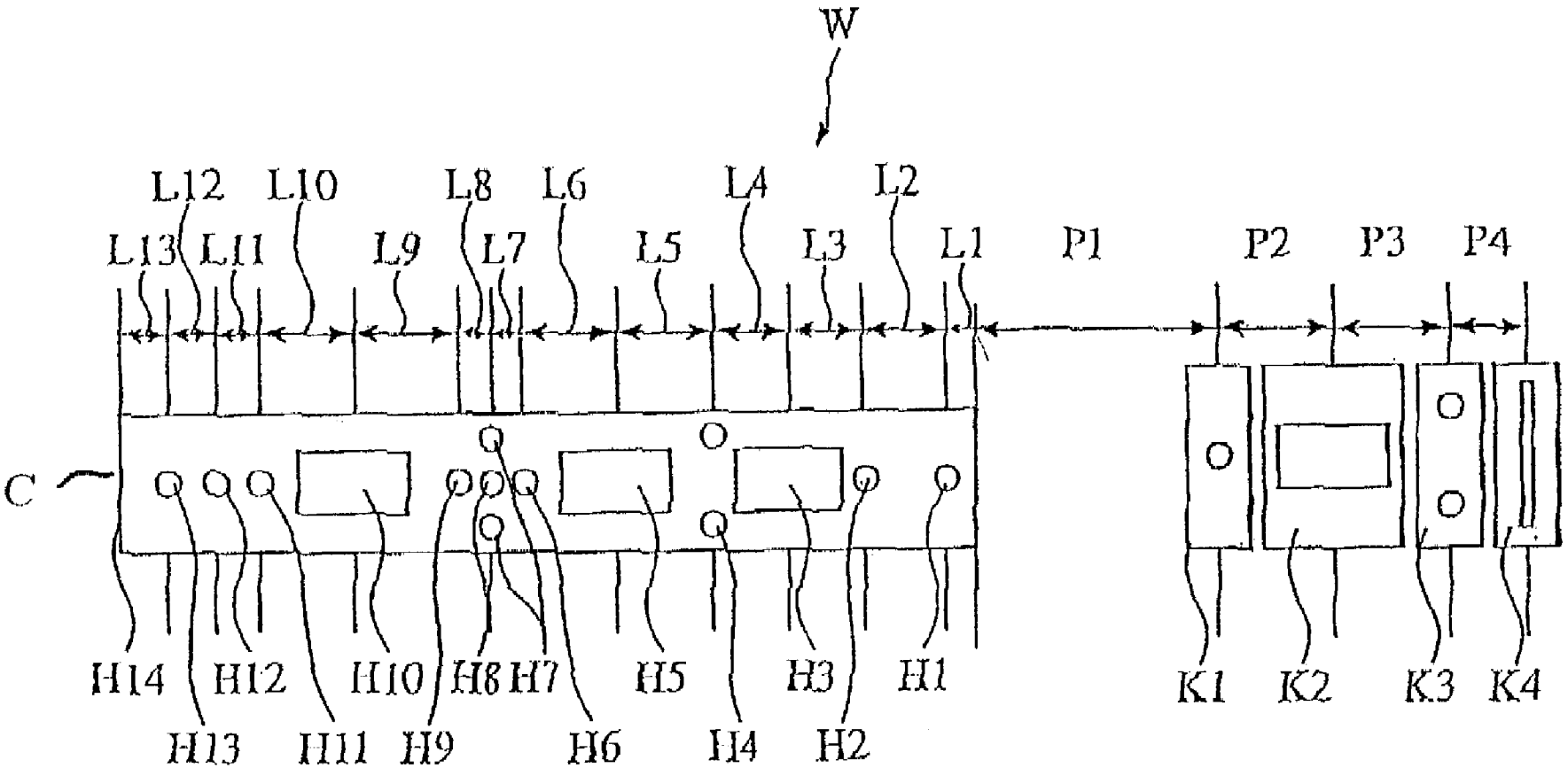
FIG. 8 illustrates a schematic diagram showing a pattern of a product and positions of the tools.

The transferring pitch and operating tool calculating device 61 calculates the transferring pitches and the order of operation of the tools in the following manner: As shown in FIG. 8, the workpiece W is to be provided with circular holes and rectangular holes H1 to H13. The pitches (distances) between adjacent holes of holes H1 to H13 of the workpiece W are denoted as L1 to L13, respectively. Spaces between a front end of the working pattern data G to centers of the tools K1 to K4 are denoted as P1 to P4, respectively. In this case, the front end of the workpiece W has been cut in advance.

In this state, distances R1, R2, R3 and R4 of movement of hole H1 to tool K1; hole H2 to tool K1; hole H3 to tool K2; and hole H4 to tool K3, respectively, at a prescribed speed are determined as follows:

Distance R1=L1+P1

Distance R2=L2+L1+P1

Distance R3=L3+L2+L1+P1+P2

Distance R4=L4+L3+L2+L1+P1+P2+P3.

The distances R1, R2, R3 and R4 are compared with one another to calculate the smallest distance. In the disclosed embodiment, distance R1 is determined as being the smallest distance. Then, the distances of movement of the holes H2, H3, H4 and H5 to the tools K1, K2, K3 and K2 from the position where the hole H1 reaches the tool K1 are calculated and compared with one another to determine the smallest distance. Thus, the order of punching all the holes H1 to H13 and a rear end C of the workpiece W is determined.

Thus, the tools required for producing holes H1 to H13 are determined as shown in FIG. 9. The order for punching holes H1 to H13 is H1, H2, H3, H4, H5, H6, H8, H9, H7, H10, H11, H12, and H13. The working of the workpieces W follows, after which the rear end C of the workpiece W is cut by tool K4.

Figure 10A:
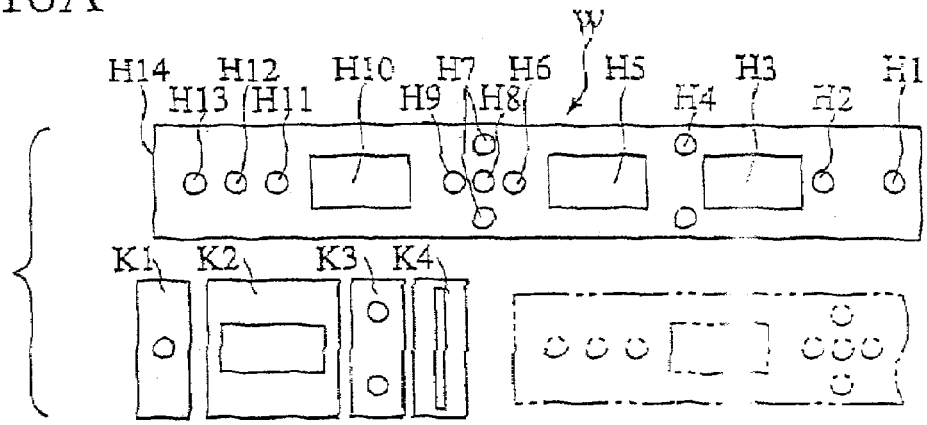
FIGS. 10A to 10Q are schematic diagrams illustrating the working of the press in accordance with the present invention.
Figure 10B:
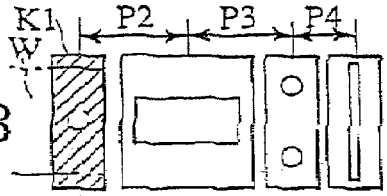
Figure 10C:
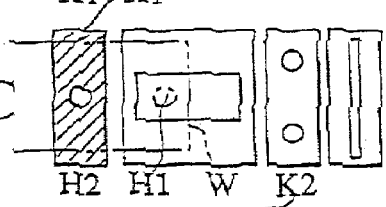
Figure 10D:
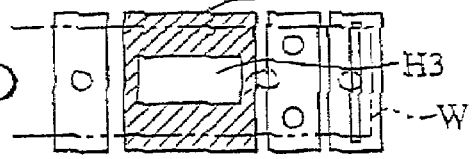
Figure 10E:
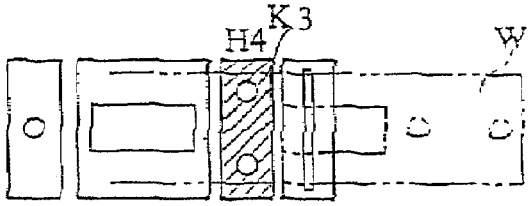
Figure 10F:
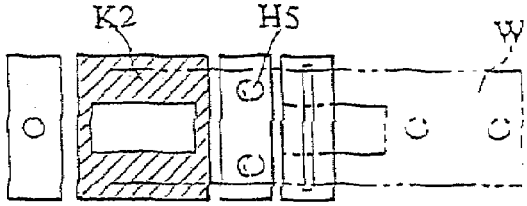

The above example will now be described with reference to the drawings. When punching holes H1 to H13 from a front end to the rear end C of the workpiece W, shown in FIG. 8, starting from the state shown in FIG. 10A, hole H1 is punched with tool K1, as shown in FIG. 10B. Then, the workpiece W is moved to the right and hole H2 is punched with tool K1, as shown in FIG. 10C. The workpiece is moved to the right and hole H3 is punched with tool K2, as shown in FIG. 10D. The workpiece is again moved to the right and hole H4 is punched with tool K3, as shown in FIG. 10E. The workpiece is moved again to the right, and hole H15 is punched with tool K2, as shown in FIG. 10F.

Figure 10G:
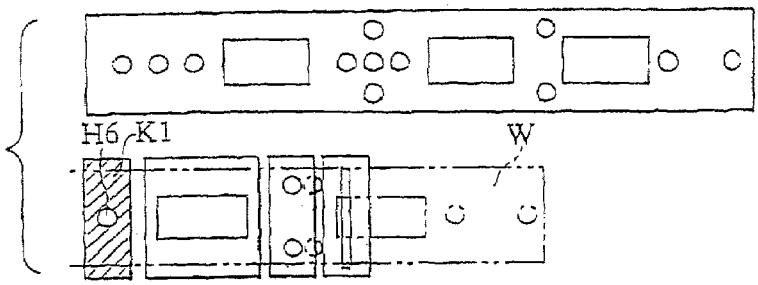
Figure 10H:
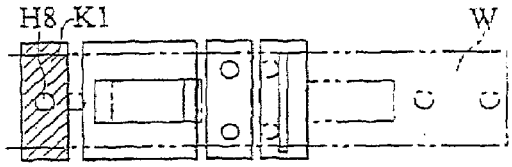
Figure 10I:
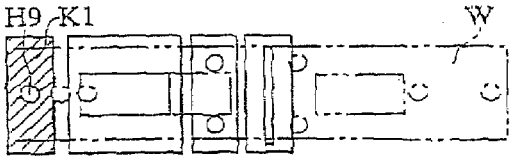
Figure 10J:
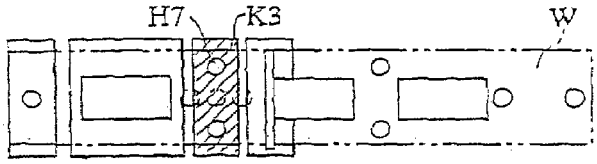

Then, as shown in FIG. 10G, hole H6 is punched with tool K1, the workpiece W is moved to the right, and hole H8 is punched with tool K1, as shown in FIG. 10H. Again, the workpiece is moved to the right, so that hole H9 is punched with tool K1, as shown in FIG. 10I. The workpiece W is moved to align hole H7 with tool K3, which punches the hole, as shown in FIG. 10J.

Figure 10K:
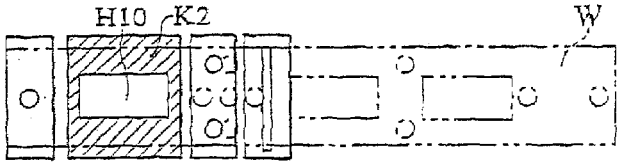
Figure 10L:
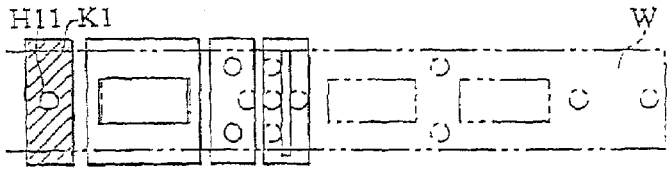
Figure 10M:
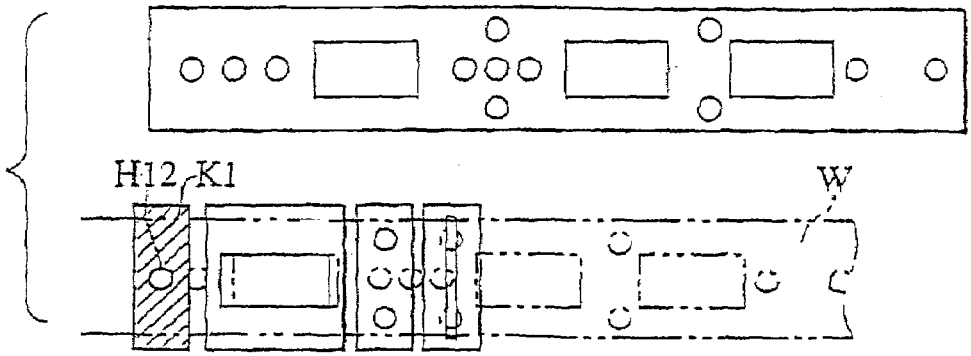
Figure 10N:
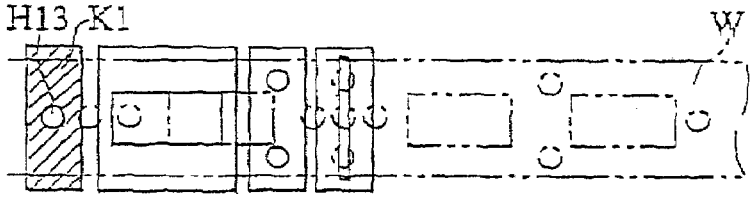
Figure 10O:
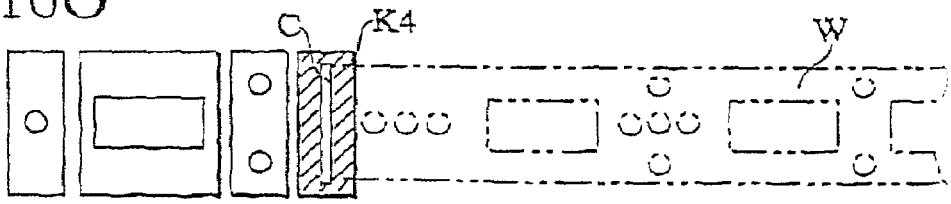

In a similar manner, the workpiece W is positioned relative to the tools K1 to K4, so that hole H10 is punched with tool K2 (see FIG. 10K). Hole H11 is punched with tool K1 (see FIG. 10L). Hole H12 is punched with tool K1 (shown in FIG. 10M). Hole H13 is punched with tool K1 (shown in FIG. 10N). Rear end C of the workpiece W is cut with tool K4 (shown in FIG. 10O).

Figure 10P:
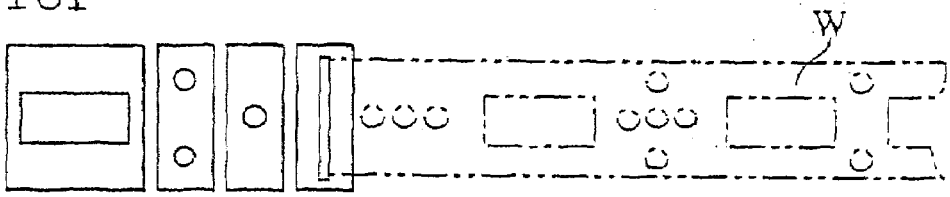
Figure 10Q:
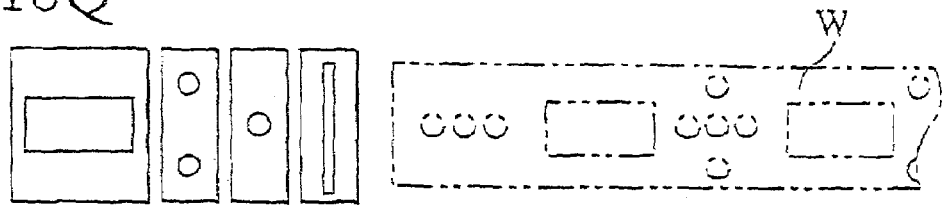

Thereafter, the workpiece W is transferred, as shown in FIGS. 10P and 10Q, for finishing the production of the workpiece. If the workpiece W is continuous (e.g., a continuous plate not cut by cut tool K4), some steps for working the next workpiece W are inserted between the state shown in FIG. 10N and the state shown in FIG. 10P.

In summary, the workpiece W is transferred in the longitudinal direction to be arranged with respect to the tools K positioned in the transferring direction of the workpiece W at a lower position of the ram which is upwardly and downwardly movable in the press, and desired tools are selected among the tools K and operated (selectively either individually or simultaneously) in various combinations to punch (press) the workpiece W. The workpiece W is fed at an arbitrary pitch in the longitudinal direction, while a tool K at the position corresponding to a position of the workpiece W to be worked is selectively operated, so that different apertures, such as, for example, round holes, rectangular holes, etc., can be punched in the product.

Further, the plurality of tools K required for punching the holes in the workpiece W is selected by the tool selecting device 57 based on the working pattern data inputted via the input device 49. The tool position determining device 59 determines the position of each tool K selected by the tool selecting device 57 in an arbitrary order at an arbitrary pitch. The transferring pitch and operating tool calculating device 61 calculates a pitch (distance) for transferring the workpiece W in order for parts of the workpiece W to be sequentially arranged to the positions of the tools determined by the tool position determining device 59 in the feeding direction, and determines a tool to be operated in association with the transferring pitch. The controlling section controls the transferring pitch calculated by the transferring pitch and operated tool calculation device 61, and the motion of the tools determined in association with the transferring pitch, to perform the press working of the workpiece W.

Thus, the workpiece W is transferred in the longitudinal direction to be arranged in the tools K positioned in the transferring direction of the workpiece W at a lower position of the ram 21 (which is upwardly and downwardly movable), and desired tools are selected from the tools K to be selectively individually (or simultaneously) operated in certain combinations for pressing (punching) the holes. When punching (pressing) the workpiece W, the workpiece W is fed at an arbitrary pitch in the longitudinal direction and the tools K are selectively operated to punch the desired hole shapes in the product, which permits working on a longer product than a conventional press.

The tool position determining device 59 arranges a tool with the greatest punch out tonnage, as selected by the tool selecting device 57, in the middle part below the ram, and arranges the remaining tools at the front and back of the middle part (e.g., fore and aft of the middle part), thereby preventing an eccentric load, which improves the punching precision.

Further, the tool position determining device 59 arranges a tool having a high punching frequency (among the tools required for working selected by the tool selecting device 57) to be center loaded, thereby improving productivity.

Further, the tool position determining device 59 arranges a tool having a shape closest to the working pattern closer to the workpiece feeding side, thereby improving productivity.

Figure 11:
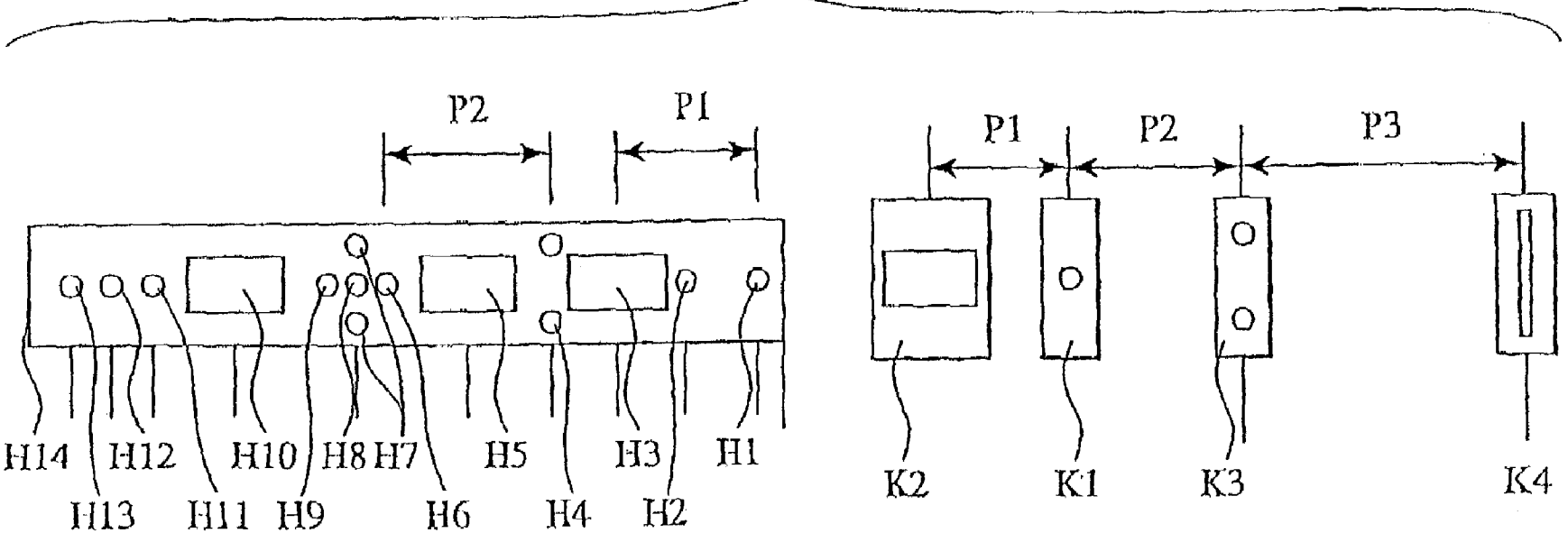
FIG. 11 is a schematic diagram illustrating a punched product and an example of a tool layout for the simultaneous punching thereof, which results in a highly efficient product production.

The present invention envisions that multiple punchings (pressings) of the workpiece W may be simultaneously performed. As an example of the simultaneous working of the working pattern data (product) G, pitches (distances) between adjacent tools are set as P1, P2 and P3, and the space between the center of hole HI and the center of hole H3, and the space between the center of hole H4 and the center of hole H6 are set the same as the pitches P1 and P2, respectively, as shown in FIG. 11. In the disclosed example, hole H1 and hole H3 are punched (pressed) at the same time, and hole H4 and hole H6 are punched at the same time. It is noted that the priority of the tool position is determined in accordance with Conditions A, B and C, discussed above.

Further, in the upper tool unit 29 and lower tool unit 31, with the punch base 39 having the punch P corresponding to the die D movable in an upward and downward direction above the die base 41 having the die D, the punch heads 39A to be struck by the striker are separately provided on the punch base 39, so that the separate punch heads 39A are simultaneously and evenly struck by the striker 25 at an increased load face pressure.

The invention is not limited to the above embodiment, but can be implemented in other embodiments with appropriate modifications. For example, while the drawings illustrate the workpiece W being fed into the press in a forward production direction, the press construction can be revised to enable a backward production direction without departing from the spirit and/or scope of the claimed invention.

As understood from the above description of the embodiment of the invention, the plurality of tools required for punching (pressing) is selected by the tool selecting device based on the working pattern data inputted via by the input device. The transferring pitch and operating tool calculating device calculates a pitch for transferring the workpiece to be sequentially arranged with respect to the positions of the tools (determined by the tool position determining device) in the feeding direction, and determines a tool to be used in association with the transferring pitch. The controlling section controls the transferring pitch calculated by the transferring pitch and operating tool calculating device. A motion of the tool, determined in association with the transferring pitch, performs the press working of the workpiece.

Thus, a strip material (such as, but not limited to, for example, an endless web coiled material) is transferred in the transferring direction of the workpiece W at a lower position of the ram, and desired tools are selected from among the plurality of tools to be individually (or simultaneously) operated for press working the workpiece W. In press working, the workpiece is fed at a predetermined arbitrary pitch in the longitudinal direction and the tools in the positions (corresponding to positions of the workpiece to be worked) are selectively operated, to punch, for example, different hole shapes, in the product, which permits working of a longer product than a conventional device. By changing the programming of the press, different length materials and different punch patterns may be processed by the press without a tool change.

According to the present invention, the plurality of tools required for working is selected by the tool selecting device based on the working pattern data inputted by the input device. The tool position determining device determines positions of the plurality of tools required for working (selected by the tool selecting device) in an arbitrary order at an arbitrary pitch. The transferring pitch and operating tool calculating device calculates a pitch for transferring the workpiece in order for parts of the workpiece to be worked to be sequentially arranged in the positions of the tools determined by the tool position determining device in the feeding direction. The transferring pitch and operating tool calculating device further determines the tool to be operated in association with the transferring pitch. The controlling section controls the transferring pitch calculated by the transferring pitch and operated tool calculation device. The motion of the tool is determined in association with the transferring pitch, to perform the press working of the workpiece.

Thus, the workpiece is transferred in the longitudinal direction to be arranged with respect to the tools positioned in the transferring direction of the workpiece W at a lower position of the ram. Desired tools are selected from among the tools to be selectively (or simultaneously) operated in various combinations for press working. In press working, the workpiece is fed at an arbitrary pitch in the longitudinal direction and tools in the positions corresponding to positions of the workpiece to be worked are selectively operated, to randomly punch different hole shapes in the product, which permits the working of a longer product than in comparison with a conventional press.

According to the present invention, a tool with the greatest punch out tonnage among the selected tools required for working (by the tool selecting device) is arranged in the middle part below the ram, and the remaining tools are arranged in front of the middle part and behind the middle part, so that an eccentric load is prevented, which results in an improved punching precision.

According to the present invention, a tool having a greater punching frequency among the selected tools (e.g., a tool that is used to punch a hole more often that the other tools as selected by the tool selecting device) is arranged to be center loaded.

Furthermore, a tool having a working pattern shape from among the selected tools (as selected by the tool selecting device 57) is arranged closer to the workpiece feeding side, thereby improving the operating productivity of the press.

Still further, the punch heads to be struck by the striker are separately provided on the punch base, so that the separate punch heads are simultaneously and evenly struck by the striker at an increased load face pressure.

In addition, because the punch heads are separated from each other by a predetermined distance with respect to the moving direction of the striker, an escape pitch can be shortened (in comparison with a conventional press), thus enabling a high-speed punching operation.

In prior art presses, it is necessary to change all the dies and punches in the press when it is desired to make a change in the punching to the workpiece W. Because the tooling station of the present invention is modular, tooling changes may be easily and quickly made. When it requires a total change of the punch figures and pattern by another tooling set, using the modular tooling station it is necessary to change only the specific tool (or few tools) and die that is affected by the punching change, changing the whole lower punch and die set or totally change including the upper striker plate. Thus, the use of the modular tooling station permits the easy changing of some (or all) of the punches P and dies D, increasing productivity and reducing manufacturing costs.

Furthermore, the present invention is compatible with various sized products (strip material or coil). The size of the product produced by the present invention is not limited to a predetermined maximum size. If a wide product size is to be produced, the punch position of the press and arrangement of the dies D and punches P to be changed or slid out, for example, in rail of die plate up to a location block to provide a material feeding and punching space. In addition, depending on the width of the material, the material may be fed from the front of the press to the rear of the press, or from the rear of the press to the front of the press, or from one side of the press to the other side of the press. Thus, the strikers move from, for example, the side or both of the opposite sides to adjusted the space for different work sizes. Further, switching from one feeding path to another feeding path is easily performed. As a result, manufacturing costs can be minimized.

While the invention has been particularly shown and described with reference to the preferred embodiment thereof, it is understood by those skilled in the art that various alterations in form and detail may be made without departing from the spirit and/or scope of the invention, as defined by the following claims.

The foregoing discussion has been provided merely for the purpose of explanation and is in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular devices, materials and embodiments, the present invention is not intended to be limited to the particulars disclosed herein; rather, the present invention extends to all functionally equivalent structures, methods and uses, such as are within the scope of the appended claims. For example, while the present invention describes various devices (such as, but not limited to, for example, a tool selecting device, a tool position determining device, etc.), it is understood that such devices may be implemented in hardware and/or software executed by an appropriate processor, which may (or may not) be the same processor associated with the controller 37. The methods described herein comprise dedicated hardware implementations including, but not limited to, application specific integrated circuits, programmable logic arrays and other hardware devices constructed to implement the methods described herein. However, it is understood that the invention may be implemented in software that is executed by a computer. Furthermore, alternative software implementations including, but not limited to, distributed processing or component/object distributed processing, parallel processing, or virtual machine processing can also be constructed to implement the methods described herein.

What is claimed is:

1. A tool apparatus, comprising:

a first punch base having a corresponding punch;

a first die base having a corresponding die, a first selected punch head programmable to be struck by a first striker which is separately provided above said first punch base, said first selected punch head being selected under a predetermined task in accordance with data related to a working pattern;

a second punch base having a corresponding punch;

a second die base having a corresponding die; and a second selected punch head programmable to be struck by a second striker which is separately provided above said second punch base, said second selected punch head being selected under the predetermined task in accordance with the data related to the working pattern, said second selected punch head being struck by the second striker independently from said first selected punch head, wherein said first selected punch head is divided into two columns which are separated in a moving direction of said first striker and struck on by said first striker; and said second selected punch head is divided into two columns which are separated in a moving direction of the second striker and struck on by the second striker striker.

* * * * *